US006196855B1

(12) United States Patent
Huang

(10) Patent No.: US 6,196,855 B1
(45) Date of Patent: Mar. 6, 2001

(54) GUIDING MECHANISM FOR GUIDING FLAT CABLE BETWEEN TWO TRAVELING MODULES

(75) Inventor: Chih-Wen Huang, Hsinchu (TW)

(73) Assignee: Umax Data Systems Inc., Hsinchu (TW)

( * ) Notice: Subject to any disclaimer, the term of this patent is extended or adjusted under 35 U.S.C. 154(b) by 0 days.

(21) Appl. No.: 09/373,608

(22) Filed: Aug. 13, 1999

(51) Int. Cl.[7] ..... H01R 3/00
(52) U.S. Cl. ..... 439/162
(58) Field of Search ..... 439/162, 10, 32, 439/39, 40, 534; 174/69, DIG. 9; 191/12 R, 12.4

(56) References Cited

U.S. PATENT DOCUMENTS 4,114,043 * 9/1978 Gansfried ..... 250/445 T

* cited by examiner

*Primary Examiner*—Brian Sircus
*Assistant Examiner*—Chandrika Prasad
(74) *Attorney, Agent, or Firm*—Dougherty & Troxell

(57) ABSTRACT

A guiding mechanism for guiding flat cable connected between two traveling modules of an image scanning device is disclosed. Two traveling modules are movable along two guide rods within the housing of the image scanning device by a predetermined speed ratio. A flat cable fixing holder is disposed on a lower portion of the first traveling module for locating one end of the flat cable under the first traveling module. A roller is disposed under the second traveling module, corresponding to the flat cable fixing holder of the first traveling module. The other end of the flat cable is extended from the fixing holder of the first traveling module and then wound over the roller and wound back toward the first traveling module and finally located on the base plate of the housing, so as to keep the flat cable in order.

5 Claims, 7 Drawing Sheets

GUIDING MECHANISM FOR GUIDING FLAT CABLE BETWEEN TWO TRAVELING MODULES

BACKGROUND OF THE INVENTION

1. Field of the Invention

The present invention relates to a guiding mechanism for flat cable, and more particularly to a guiding mechanism for keeping flat cable connected between two traveling modules of an image scanning device.

2. Description of the Prior Art

In various kinds of optical devices or electric appliances (such as image scanner, photo copier, test instrument, etc.), two traveling modules are often equipped therein. For example, as shown in FIG. 1, it is a perspective view of a conventional optical image scanning device, showing that a focusing lens 2, a protective cover 3, a pair of corresponding guide rods 4*a*, 4*b*, and two movable traveling modules 5*a*, 5*b* are arranged in the housing 1 of the conventional optical image scanner.

The guide rods 4*a*, 4*b* serve as a guiding mechanism for guiding two traveling modules 5*a*, 5*b*. The first traveling module 5*a* carries a light tube as a light source for the image scanning device, while the second traveling module 5*b* carries a set of reflection mirrors for reflecting the light projected from the light source. During scanning, a document to be scanned is placed on a document positioning plate of the scanner. It is known that the document positioning plate is a plane surface made, for example, from glass or other light transmittable, substantially rigid material for supporting a document to be scanned. The light tube of the first traveling module 5*a* projects a light toward the document and then the light is reflected by the reflection mirror of the second traveling module 5*b*. The first and second traveling modules 5*a*, 5*b* are arranged to achieve a necessary scanning optical path during scanning. Typically, the first and second traveling modules 5*a*, 5*b* may be moved by a conventional driving motor via a transmission rope (not shown). In general, the ratio of the speed of the first traveling module 5*a* to the speed of the second traveling module 5*b* is 2:1.

Normally, a circuit board 7 is mounted on a side wall of the first traveling module 5*a*. One end of a flat cable 6 disposed with a connector 61 is electrically connected to the circuit board 7. The other end of the flat cable 6 extends to connect with a fixed position 11 of the base plate 12 of the housing or a protective cover 3 mounted on the housing 1. The protective cover 3 contains therein a circuit board and other relevant electronic components.

The flat cable 6 generally has a certain flexibility. However, the minimum curvature radius and the tolerable number of bending times of the flat cable 6 are limited. Since the traveling modules need to frequently move left and right, the flat cable 6 will be repeatedly bent. In the case of too large of a bending angle, the flat cable 6 may be broken or damaged.

Moreover, the width of the existing flat cable is narrower and narrower (the number of pins is reduced) with longer length (such as used in scanning of A3 size document). Therefore, during the movement of the traveling modules, the flat cable is likely to curve and touch other components arranged in the housing of the image scanning device or even be rolled into the traveling mechanism. In addition, the flat cable may swing left and right during movement of the traveling modules. These all lead to lowered reliability and shortened usable life of the scanner.

SUMMARY OF THE INVENTION

It is therefore a primary object of the present invention to provide a guiding mechanism for flat cable connected between two traveling modules. By means of the guiding mechanism of the present invention, when two traveling modules move, the flat cable is kept in a properly tensioned state and can be smoothly bent without deflection. Therefore, the problem existing in the conventional traveling modules that the flat cable may be rolled into the traveling modules, abraded, broken or swung left and right can be eliminated.

To achieve the above object of the present invention, a flat cable fixing holder is disposed on a lower portion of the first traveling module for locating one end of the flat cable under the first traveling module. A roller is disposed under the second traveling module, corresponding to the flat cable fixing holder of the first traveling module. The other end of the flat cable is extended from the fixing holder of the first traveling module and then wound over the roller and wound back toward the first traveling module and finally located on a base plate of the housing. After installation, the flat cable is slightly tensioned by a certain tensile strength without suspending. Accordingly, when the first and second traveling modules displace and move, the flat cable is kept in a properly tensioned state and can be smoothly bent without deflection.

The present invention can be best understood through the following description and accompanying drawings wherein:

DETAILED DESCRIPTION OF THE PREFERRED EMBODIMENT

Figure 1:
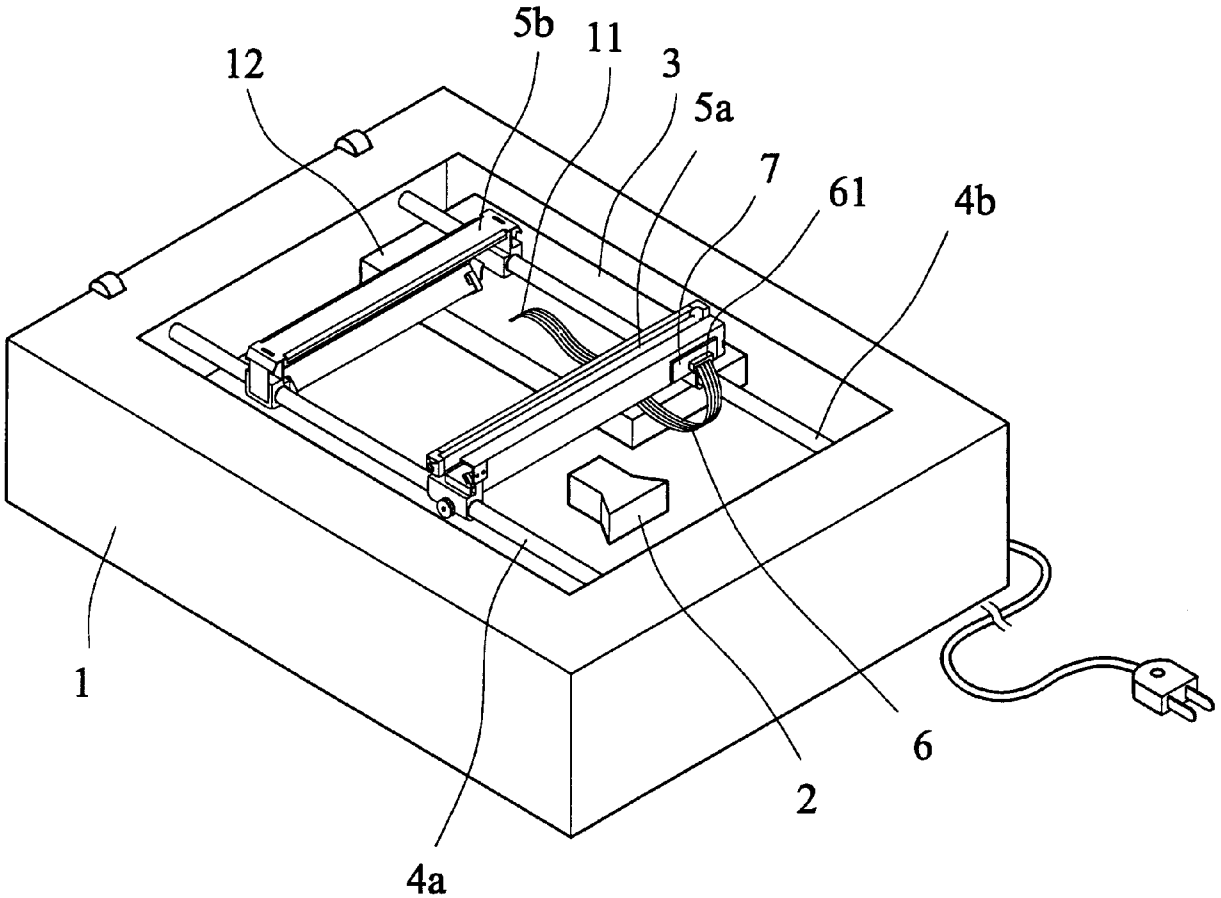
FIG.1 (Prior Art)
FIG. 1 is a perspective view of a conventional scanner.
Figure 2:
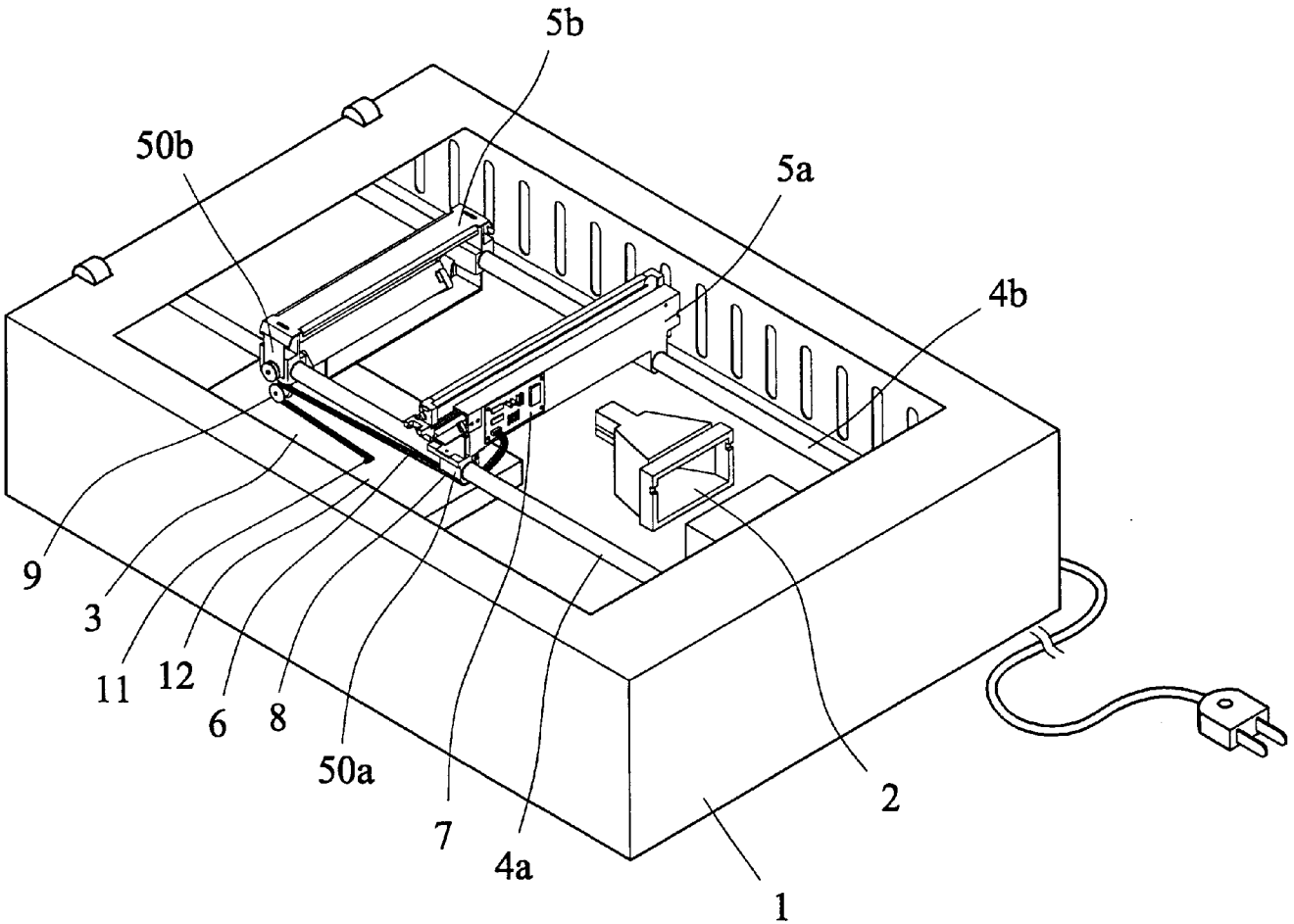
FIG. 2 is a perspective view showing that the present invention is applied to a scanner.
Figure 3:
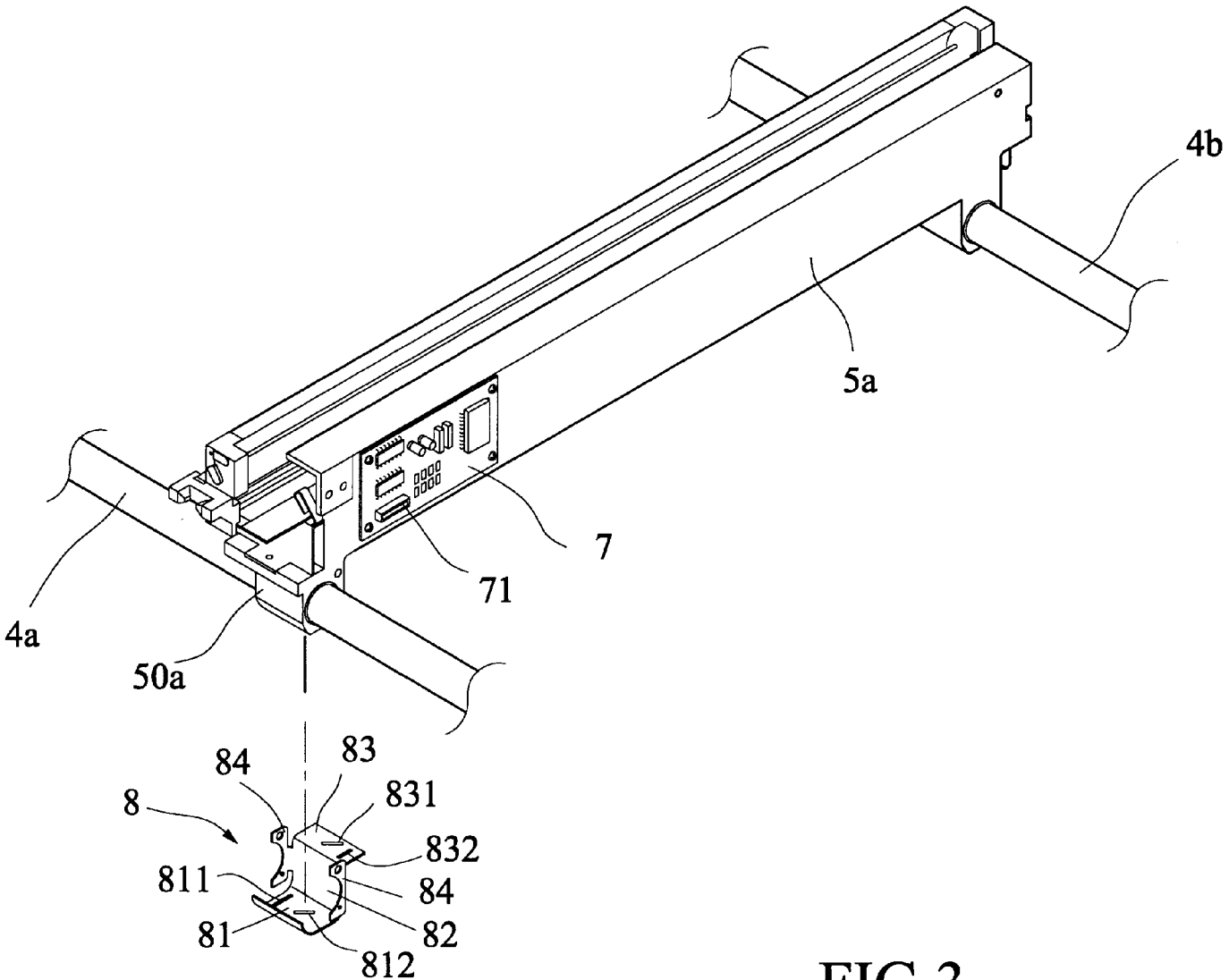
FIG. 3 is a perspective exploded view showing the flat cable fixing holder of FIG. 2, which is separated from the first traveling module.
Figure 4:
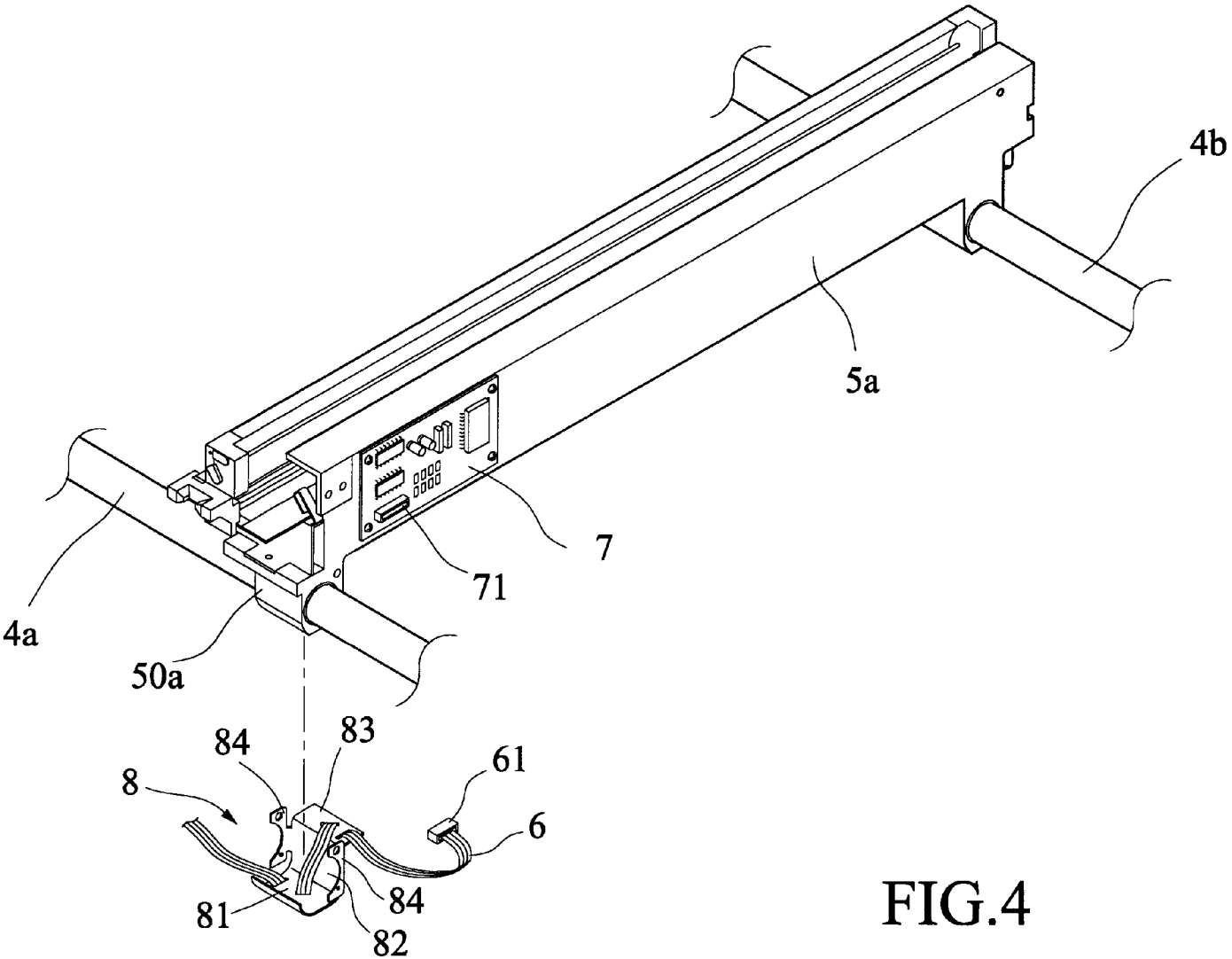
FIG. 4 is a perspective exploded view showing the flat cable fixing holder of FIG. 3, which is further connected with the flat cable and separated from the first traveling module.
Figure 5:
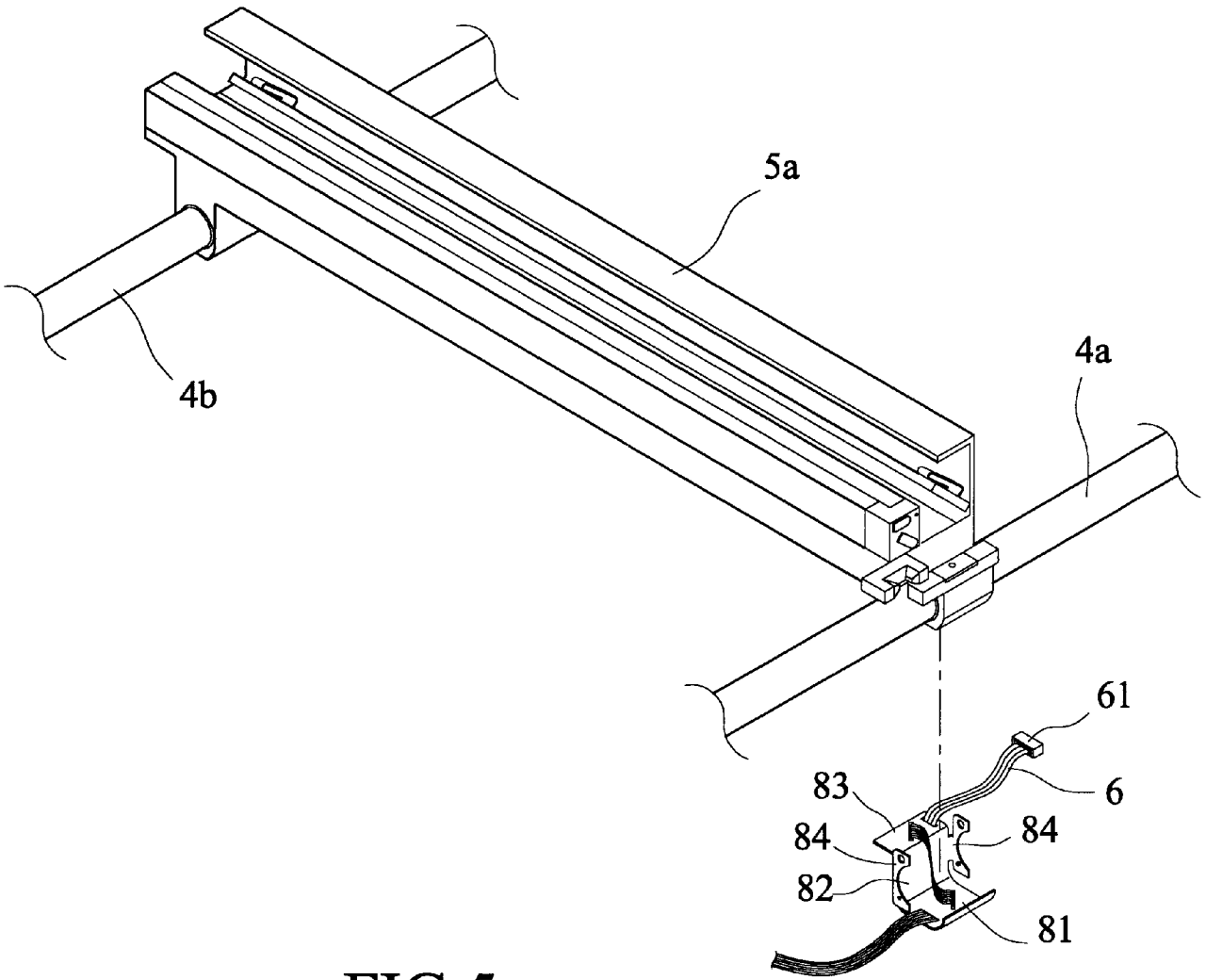
FIG. 5 is a rear perspective exploded view showing the flat cable fixing holder of FIG. 3, which is connected with the flat cable and separated from the first traveling module.

With reference to FIG. 2, it is a perspective view showing the image scanning device of the present invention. The image scanning device mainly includes a housing 1, a focusing lens 2, a protective cover 3, two corresponding guide rods 4*a*, 4*b*, two traveling modules 5*a*, 5*b*, a flat cable 6, a circuit board 7, and a base plate 12. Referring to FIGS. 3, 4 and 5, the cable guiding mechanism of the present invention includes a flat cable fixing holder 8 fitted on a lower portion of the shaft hole seat 50*a* of the first traveling module 5*a*. A first end of the flat cable 6 is firmly held and located by the fixing holder 8. Then a connector 61 connected with the first end of the flat cable 6 is plugged into a socket 71 of the circuit board 7 disposed on a side wall of the first traveling module 5*a*.

In a preferred embodiment of the present invention, the flat cable fixing holder 8 includes a base plate 81, a vertical plate 82 and an extension plate 83 (as shown in FIG. 3). The fixing holder 8 is such dimensioned as to just fit on lower portion of the shaft hole seat 50*a* of the first traveling module 5*a*. The vertical plate 82 is formed with vanes 84 on two lateral edges. By means of the vanes 84 and any conventional fixing measures (such as screws, bolts, welding, etc.), the fixing holder 8 can be firmly fixed on the lower portion of the shaft hole seat 50*a*.

The base plate 81 of the fixing holder 8 is formed with a slot 811 and an oblique slot 812. The extension plate 83 of the fixing holder 8 is also formed with a similar oblique slot 831 and a slot 832. The slots are such dimensioned as to meet the size of the flat cable.

When connecting the flat cable 6 with the fixing holder 8 (referring to FIGS. 4 and 5), one end of the flat cable 6 is sequentially conducted through the slot 811 and oblique slot 812 of the base plate 81 of the fixing holder 8 and then conducted through the oblique slot 831 and slot 832 of the extension plate 83. By means of the structural design of the flat cable fixing holder 8, the flat cable can be firmly held by the fixing holder 8 and can be bent and turned in accordance with the position of the circuit board 7.

Figure 6:
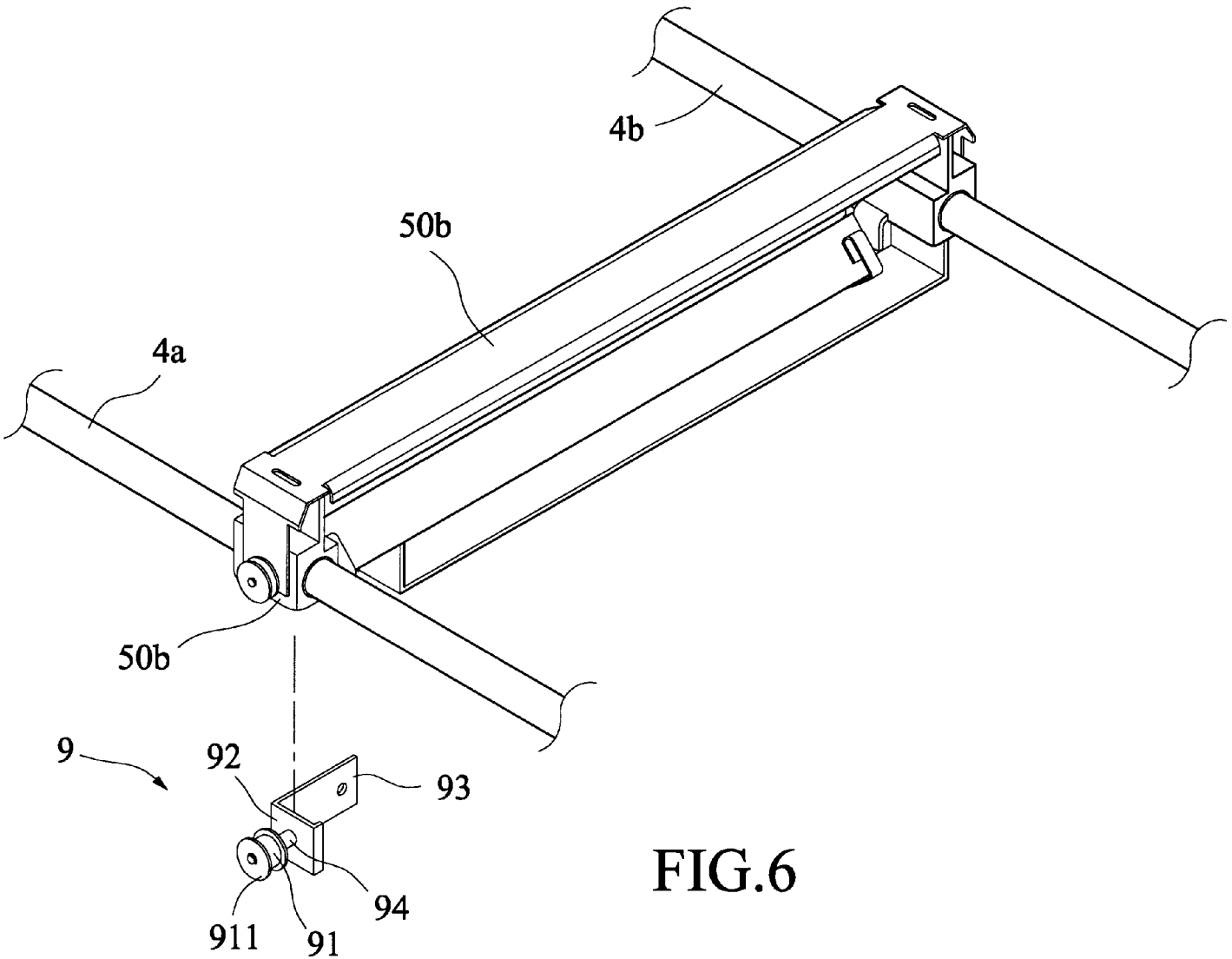
FIG. 6 is a perspective exploded view showing the roller mechanism of FIG. 2, which is separated from the second traveling module.
Figure 7:
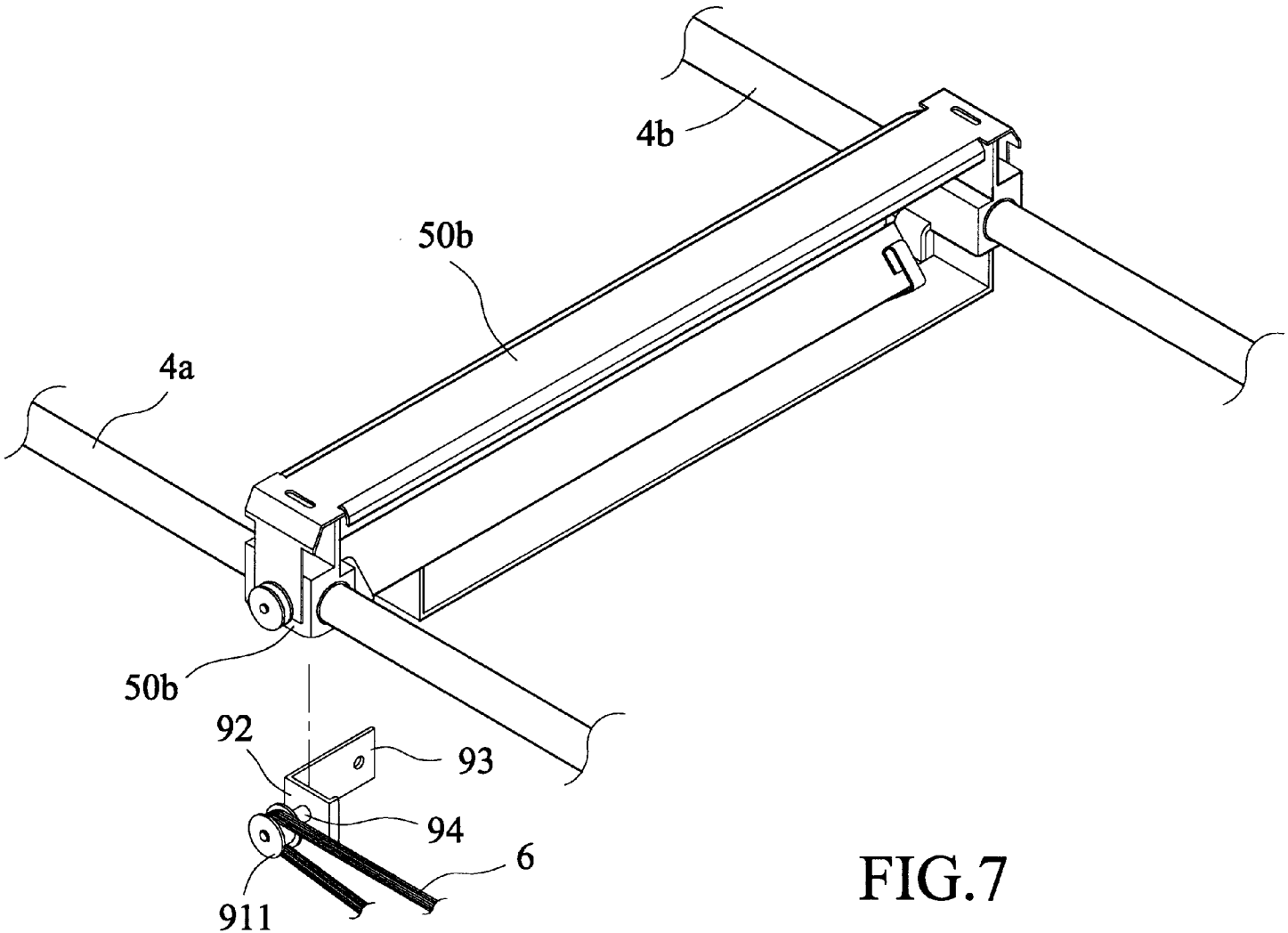
FIG. 7 is a perspective exploded view showing the roller of FIG. 6, on which the flat cable is wound and which is separated from the second traveling module.

A roller mechanism 9 is disposed under the shaft hole seat 50*b* of the second traveling module 5*b* (referring to FIGS. 6 and 7). The roller mechanism 9 includes a roller 91, a roller locating plate 92 and an extension plate 93. The roller 91 is located on an outer side of the locating plate 92 by a shaft rod 94. Via the extension plate 93, the roller 91 is fixed under the shaft hole seat 50*b* of the second traveling module 5*b* by means of conventional fixing measure (such as screws, bolts or welding). Preferably, the rim of the roller 91 is formed with roller flanges 911 with a larger diameter so as to ensure that the flat cable be reliably wound on the rim of the roller 91 without detachment.

When assembled, the first end of the flat cable 6 with a predetermined length is connected to the circuit board 7 of the first traveling module 5*a*. Then the end section is fixedly located under the shaft hole seat 50*a* of the first traveling module 5*a* by the fixing holder 8. Then the second end of the flat cable 6 is extended and wound on the roller 91 under the shaft hole seat 50*b* of the second traveling module 5*b* and finally wound back to a fixed position 11 on the protective cover 3 or the base plate 12 of the scanner housing 1. Therefore, after installation, the flat cable is slightly tensioned by a certain tensile strength without suspending. Accordingly, when the first and second traveling modules 5*a*, 5*b* displace and move, the flat cable is kept in a properly tensioned state and can be smoothly bent without deflection. Therefore, the problem existing in the conventional structure that the flat cable may be rolled into the traveling modules, abraded, broken or swung left and right can be eliminated.

The above embodiment is only used to illustrate the present invention, not intended to limit the scope thereof. Many modifications of the above embodiment can be made without departing from the spirit of the present invention.

What is claimed is:

1. A guiding mechanism for guiding a flat cable in an image scanning device having a single pair of guide rods in a housing having a first base plate, said guiding mechanism comprising:

a) a first traveling module including a shaft hole seat slidably mounted on one of the guide rods;

b) a second traveling module movably located in the housing;

c) a flat cable fixing holder attached to the shaft hole seat of the first traveling module, and including:

i) a second base plate formed with a first slot and a first oblique slot;

ii) an extension plate formed with a second slot and a second oblique slot; and iii) a vertical plate with two lateral edges and connected between the base plate and the extension plate;

d) a roller mechanism including a roller and attached to the second traveling module; and, e) a flat cable having a first end portion passing sequentially through the first slot, the first oblique slot, the second oblique slot, and the second slot so as to fixedly attach the first end portion to the first traveling module, and, a second end portion located on the first base plate, wherein a portion of the flat cable between the first and second end portions passes over the roller of the roller mechanism.

2. The guiding mechanism as claimed in claim 1, wherein the vertical plate further comprises a pair of vanes respectively formed on the two lateral edges thereof.

3. The guiding mechanism as claimed in claim 1, wherein the second traveling module includes a second shaft hole seat slidably mounted on one of the guide rods wherein the roller of the roller mechanism is positioned on a lower portion of the second shaft hole seat.

4. The guiding mechanism as claimed in claim 3, wherein the roller mechanism further comprises a roller locating plate and an extension plate, the roller being located on the locating plate by a shaft rod, the extension plate being fixed on the second traveling module so as to locate the roller on the lower portion of the second shaft hole seat.

5. The guiding mechanism as claimed in claim 1, wherein the roller further comprises a pair of roller flanges having diameters larger than a diameter of the roller so as to ensure that the flat cable be reliably wound on the roller without detachment from the roller.

* * * * *